US011592157B1

(12) United States Patent
Jiang

(10) Patent No.: US 11,592,157 B1
(45) Date of Patent: Feb. 28, 2023

(54) STAGE LIGHT WITH LENS BUFFERING FEATURE

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/537,771

(22) Filed: Nov. 30, 2021

(30) Foreign Application Priority Data

Aug. 30, 2021 (CN) ..... 202122050232.6

(51) Int. Cl.

| | |
|---|---|
| ***F21V 14/00*** | (2018.01) |
| ***F21V 5/04*** | (2006.01) |
| ***F21V 14/04*** | (2006.01) |
| ***F21V 14/06*** | (2006.01) |
| *F21W 131/406* | (2006.01) |

(52) U.S. Cl.
CPC ..... *F21V 5/04* (2013.01); *F21V 14/04* (2013.01); *F21V 14/06* (2013.01); *F21W 2131/406* (2013.01)

(58) Field of Classification Search
CPC . F21V 5/04; F21V 14/04; F21V 14/06; F21V 21/096; F21W 2131/406; G02B 7/04; G02B 7/023; G02B 25/002
See application file for complete search history.

(56) References Cited

U.S. PATENT DOCUMENTS

2017/0123226 A1* 5/2017 Hu ..... G02B 7/023
2021/0381680 A1* 12/2021 Jiang ..... F21V 21/096

FOREIGN PATENT DOCUMENTS

| | | | |
|---|---|---|---|
| CN | 109668122 | A | 4/2019 |
| CN | 110554504 | A | 12/2019 |
| DE | 202012003108 | U1 | 1/2013 |
| WO | WO-2019154052 | A1 | 8/2019 |
| WO | WO-2021103704 | A1 | 6/2021 |

* cited by examiner

*Primary Examiner* — Y M. Quach Lee
(74) *Attorney, Agent, or Firm* — Muncy, Geissler, Olds & Lowe, P.C.

(57) ABSTRACT

A stage light with a lens buffering feature includes a light source emitting light along an optical path and a dimming lens provided on the optical path. The dimming lens is mounted on a mounting plate and moves freely along the optical path under the driving of a drive mechanism. A limit plate is provided on at least one side of the dimming lens along the direction of the optical path, and the limit plate is provided with a first buffering magnet thereon. The mounting plate is provided with a second buffering magnet corresponding to the first buffering magnet, and the polarities of the sides of the first buffering magnet and the second buffering magnet close to each other are the same. When the stage light is suddenly powered off or during transportation, the dimming lens or the mounting plate can avoid collision with other components.

13 Claims, 2 Drawing Sheets

STAGE LIGHT WITH LENS BUFFERING FEATURE

CROSS REFERENCE TO RELATED APPLICATIONS

The present application claims priority from Chinese Patent Application No. 202122050232.6 filed on Aug. 30, 2021, all of which are hereby incorporated herein by reference.

TECHNICAL FIELD

The present application relates to the technical field of stage lights, and more particularly, relates to a stage light with a lens buffering feature.

BACKGROUND

In order to adjust the size and definition of the projected light spot of the stage light, it is necessary to set a magnifying lens or focusing lens in the stage light. However, the adjustment ranges of size and definition of the light spot of stage lights are generally wide, long moving distance of the magnifying lens or focusing lens is thus required to achieve adjustment of size and definition of the light spot. Accordingly, when the stage light is suddenly powered off or in transportation, the magnifying lens or focusing lens is prone to violent collision with other components under the action of gravity, causing abnormal noise or damage.

SUMMARY

The present application thus provides a stage light with a lens buffering feature, which can effectively avoid abnormal noise or damage caused by the falling of the dimming lens.

According to the present invention, a stage light with a lens buffering feature includes a light source emitting light along an optical path and a dimming lens provided on the optical path. The dimming lens is mounted on a mounting plate and is configured to move freely along the optical path under the driving of a drive mechanism. A limit plate is provided on at least one side of the dimming lens along the direction of the optical path. The limit plate is provided with a first buffering magnet thereon. The mounting plate is provided with a second buffering magnet corresponding to the first buffering magnet. Polarities of the sides of the first buffering magnet and the second buffering magnet close to each other are the same.

In the present invention, the stage light with a lens buffering feature provides the second buffering magnet on the mounting plate on which the dimming lens is mounted, and a first buffering magnet on the limit plate arranged on at least one side of the dimming lens. the sides of the first buffering magnet and the second buffering magnet close to each other have the same polarities. With such configuration, in the case where the stage light is suddenly powered off or during transportation, when the dimming lens moves towards the limit plate, with the mutual repulsion between the first buffering magnet and the second buffering magnet, the dimming lens or the mounting plate can avoid collision with other components. During buffering between the first buffering magnet and the second buffering magnet, no contact between the two is occurred, no friction or collision noise thus will cause. In addition, since the interaction force is greater as the magnets are closer, when the dimming lens is a little farther away from the limit plate, the interaction force between the magnets will be smaller, the drive mechanism driving the mounting plate thus will not be affected by the interaction force.

According to the present invention, the first buffering magnet and/or the second buffering magnet are fixed by pasting, screws or a mounting box. It can be freely selected according to the structure and installation requirements of the first buffering magnet and/or the second buffering magnet.

According to the present invention, the limit plate is located on one side of the dimming lens far away from the light source. With such configuration, the first buffering magnet applies a force to the second buffering magnet, which can prevent the dimming lens from falling in a direction away from the light source and colliding with other components.

According to the present invention, a shelf extending along the emission direction of the optical path is fixed on the mounting plate, and the second buffering magnet is fixed to the shelf. Since the mounting plate is generally fixed at the middle position of the dimming lens along the direction of the optical path, the front and rear ends of the dimming lens will protrude from the mounting plate, especially the side of the dimming lens far away from the light source is generally a spherical protrusion, which will be easy to contact with other components prior to the mounting plate. The height of the second buffering magnet can be increased with configuration of the shelf, so that it interacts with the first buffering magnet in advance to perform buffering and avoid collision.

According to the present invention, the limit plate has a strip-shaped guide hole extending along the direction of the optical path. The limit plate is fixed by a screw passing through the strip-shaped guide hole. With the function of the strip-shaped guide hole, when the screw is slightly loosened, the limit plate can be moved slightly along the direction of the optical path, and the position of the limit plate can be fine-tuned to ensure that the mounting plate can be completely stopped immediately before colliding with other components.

According to the present invention, the limit plate is located on the side of the dimming lens close to the light source. With such configuration, the first buffering magnet applies a force to the second buffering magnet to prevent the dimming lens from falling towards the light source and colliding with other components.

According to the present invention, the limit plate has an access hole thereon, and the first buffering magnet is located in the access hole. When the limit plate cannot be mounted at a sufficient distance from the mounting plate due to the limited space in the stage light, the first buffering magnet can be mounted in an access hole provided on the limit plate so as to make the distance between the first buffering magnet and the mounting plate sufficient to reduce the repulsive force to the second buffering magnet.

According to the present invention, the mounting plate or the limit plate is further provided with a contact buffer thereon, and when the mounting plate compresses the contact buffer to an extreme position, the distance between the first buffering magnet and the second buffering magnet is greater than zero. The contact buffer and the first buffering magnet can cooperate to buffer the mounting plate to enhance the buffering force, and the repulsive force between the first buffering magnet and the second buffering magnet is sufficient to ensure that the two never contact each other, which avoids strong collision between the first buffering magnet and the second buffering magnet, emission of abnormal noise or damage.

According to the present invention, the mounting plate or the limit plate is further provided with a contact buffer thereon, and when the contact buffer is in contact with the limit plate or the mounting plate, the distance between the first buffering magnet and the second buffering magnet is less than 8 mm and greater than 3 mm. The contact buffer and the first buffering magnet can operate to buffer the mounting plate to enhance the buffering force, and an elastic deformation space of 3 mm to 8 mm is reserved for the contact buffer, so that the contact buffer can provide an effective buffering force, and the contact buffer will not affect the movement of the dimming lens during normal operation.

According to the present invention, the contact buffer is a soft rubber pad and is fixed to the mounting plate or a fixing post on the limit plate. On one hand, the fixing post can increase the height of the soft rubber pad, and on the other hand, it facilitates the fixing of the soft rubber pad.

According to the present invention, the dimming lens is a magnifying lens or a focusing lens. The magnifying lens or the focusing lens is generally heavy and has a large moving distance. Therefore, large impact force will be caused when collision with other components, resulting in damage. Buffering is thus required to avoid such situation.

According to the present invention, the first buffering magnet can be a power-off type electromagnet that loses magnetism when powered on and generates a magnetic force when powered off. Therefore, it can avoid to affect the drive mechanism driving the dimming lens during normal operation of the stage light, and the dimming lens is only buffered when the power is off.

Figure 1:
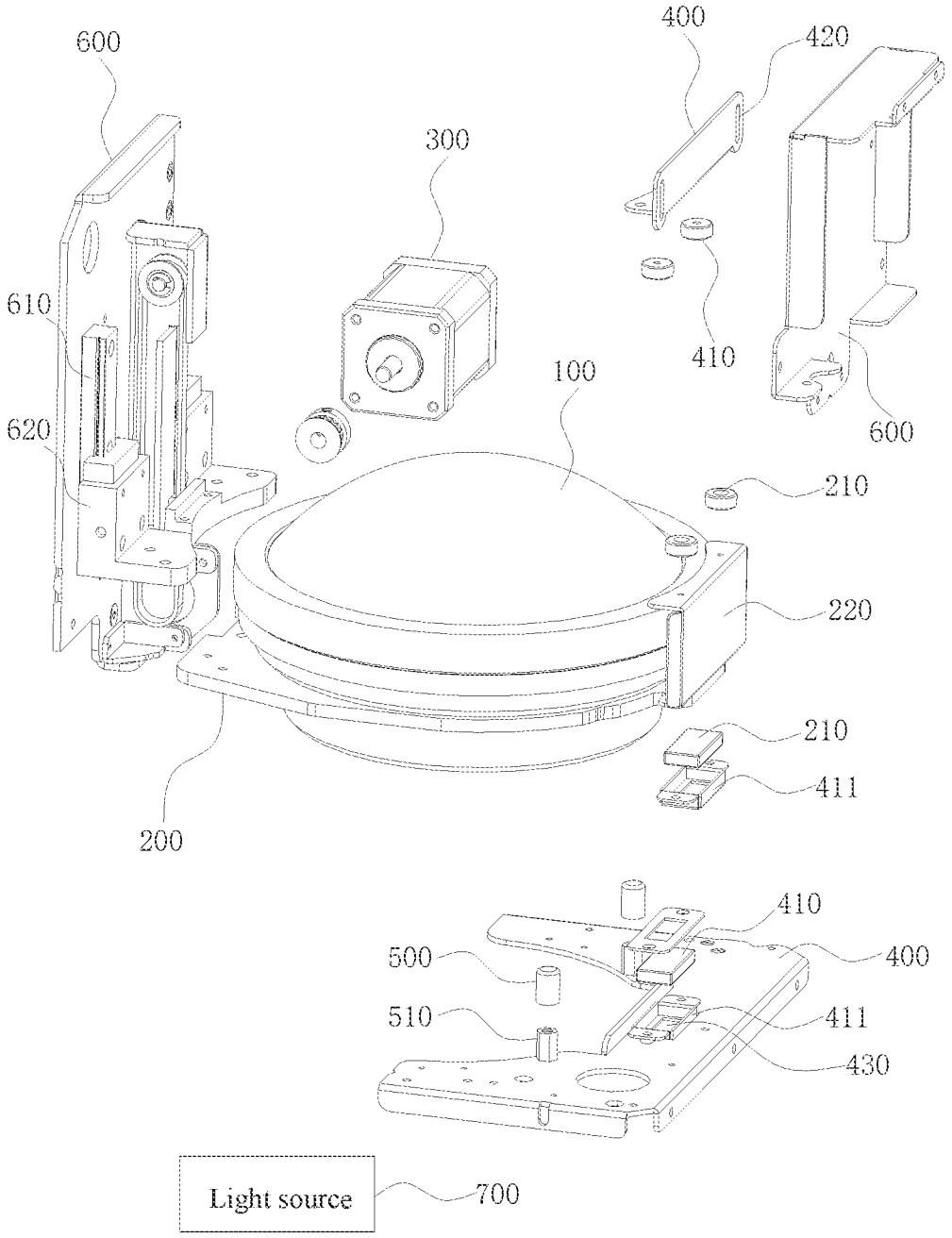
FIG. 1 is an explosion view of a stage light with a lens buffering feature according to the present application.

In the drawings, the reference numerals are listed below:

100 dimming lens, 200 mounting plate, 210 second buffering magnet, 220 shelf, 300 drive mechanism, 400 limit plate, 410 first buffering magnet, 411 mounting box, 420 strip-shaped guide hole, 430 access hole, 500 contact buffer, 510 fixing post, 600 side plate, 610 sliding rail, 620 slider.

DETAILED DESCRIPTION

The drawings are only for illustrative purposes and cannot be understood as a limitation of this patent; in order to better illustrate this embodiment, some parts of the drawings may be omitted, enlarged or reduced, and do not represent the size of the actual product; it is understandable for those skilled in the art that some well-known structures in the drawings and their descriptions may be omitted. The positional relationship described in the drawings is only for illustrative purposes and cannot be understood as a limitation of this patent.

As shown in FIG. 1, the present embodiment provides a stage light with a lens buffering feature, including a light source 700 emitting light along an optical path and a dimming lens 100 provided on the optical path. The dimming lens 100 is mounted on a mounting plate 200 and can move freely along the optical path under the driving of a drive mechanism 300. A limit plate 400 is provided on at least one side of the dimming lens 100 along the direction of the optical path. The limit plate 400 is provided with a first buffering magnet 410 thereon, and the mounting plate 200 is provided with a second buffering magnet 210 corresponding to the first buffering magnet 410. The sides close to each other of the first buffering magnet 410 and the second buffering magnet 210 have same polarities.

According to the present embodiment, the stage light with a lens buffering feature provides a second buffering magnet 210 on the mounting plate 200 on which the dimming lens 100 is mounted, and a first buffering magnet 410 on the limit plate 400 arranged on at least one side of the dimming lens 100. The sides close to each other of the first buffering magnet 410 and the second buffering magnet 210 are designed in same polarities. With such configuration, in the case where the stage light is suddenly powered off or in transportation, when the dimming lens 100 moves towards the limit plate 400, with the mutual repulsion between the first buffering magnet 410 and the second buffering magnet 210 due to the same polarity, the dimming lens 100 or the mounting plate 200 can avoid collision with other components. What's more, with such configuration, during buffering between the first buffering magnet 410 and the second buffering magnet, no contact between the two is occurred, no friction or collision noise thus will cause. In addition, since the interaction force is larger as the magnets are closer, when the dimming lens 100 is a little farther away from the limit plate 400, the interaction force between the magnets will be smaller, the drive mechanism 300 driving the mounting plate 200 thus will not be affected by the interaction force.

Optionally, a side plate 600 is provided in the head of the stage light. A sliding rail 610 is arranged on the side plate 600. A slider 620 is arranged on the sliding rail 610, and one side of the mounting plate 200 is connected to the slider 620. The second buffering magnet 210 is located on the other side of the mounting plate 200.

In a preferred embodiment, the first buffering magnet 410 and/or the second buffering magnet 210 are fixed by pasting, screws or a mounting box 411. It is free to choose fixing method according to the structure and installation requirements of the first buffering magnet 410 and/or the second buffering magnet 210.

Optionally, when the first buffering magnet 410 and/or the second buffering magnet 210 have a through hole, such as in a circular ring shape, they are fixed by pasting or screws. When the first buffering magnet 410 and/or the second buffering magnet 210 have no through hole or when it is inconvenient for them to be fixed by pasting or screws, such as in a rectangular shape, the mounting box 411 can be used for fixing. That is, the first buffering magnet 410 and/or the second buffering magnet 210 are placed in the mounting box 411, and then the mounting box 411 is fixed by screws, pasting or other means.

In a preferred embodiment, the limit plate 400 is located on one side of the dimming lens 100 far away from the light source 700. With such configuration, the first buffering magnet 410 applies a force to the second buffering magnet 210, which can prevent the dimming lens 100 from falling in a direction away from the light source 700 and colliding with other components.

In a preferred embodiment, a shelf 220 extending along the emission direction of the optical path is fixed on the mounting plate 200, and the second buffering magnet 210 is fixed on the shelf 220. Since the mounting plate 200 is generally fixed at the middle position of the dimming lens 100 along the direction of the optical path, the front and rear ends of the dimming lens 100 will protrude from the mounting plate 200, especially the side of the dimming lens 100 far away from the light source 700 is generally a spherical protrusion, which will be easy to contact other components prior to the mounting plate 200. The height of the second buffering magnet 210 can be increased with configuration of the shelf 220, so that it interacts with the first buffering magnet 410 in advance to perform buffering and avoid collision with other components.

Optionally, the side edges of the shelf 220 are bent to increase the strength of the shelf 220 or to mount the second buffering magnet 210.

In a preferred embodiment, the limit plate 400 has a strip-shaped guide hole 420 thereon extending along the direction of the optical path. The limit plate 400 can be fixed by a screw passing through the strip-shaped guide hole 420. With the function of the strip-shaped guide hole 420, when the screw is slightly loosened, the limit plate 400 can be moved slightly along the direction of the optical path, and the position of the limit plate 400 can be fine-tuned to ensure that the mounting plate 200 can be completely stopped immediately before colliding with other components.

Optionally, the number of the strip-shaped guide holes 420 is two.

Optionally, the limit plate 400 is fixed on the side plate 600 in the head of the stage light through the strip-shaped guide hole 420 and the screw, and the sliding rail 610 of the mounting plate 200 is mounted on another side plate 600 provided oppositely.

In a preferred embodiment, the limit plate 400 is located on the side of the dimming lens 100 close to the light source 700. With such configuration the first buffering magnet 410 applies a force to the second buffering magnet 210 to prevent the dimming lens 100 from falling toward the light source 700 and colliding with other components.

In a preferred embodiment, the limit plate 400 has an access hole 430. The first buffering magnet 410 is located in the access hole 430. When the limit plate 400 cannot be mounted at a sufficient distance from the mounting plate 200 due to the limited space in the stage light, the first buffering magnet 410 can be mounted in an access hole 430 provided on the limit plate 400 so as to make the distance between the first buffering magnet 410 and the mounting plate 200 sufficient to reduce the repulsive force to the second buffering magnet 210.

Optionally, the limit plate 400 is located on the side of the dimming lens 100 close to the light source 700. Since the closer to the light source 700, the tighter the arrangement of the components and the more compact the structure, on the premise of not changing the stroke of the dimming lens 100, with the configuration of the access hole 430 on the limit plate 400, the space occupied by the limit plate 400 and the first buffering magnet 410 in the direction of the optical path can be effectively saved.

In a preferred embodiment, a contact buffer 500 is further provided on the mounting plate 200 or on the limit plate 400, and when the mounting plate 200 compresses the contact buffer 500 to an extreme position, the distance between the first buffering magnet 410 and the second buffering magnet 210 is greater than zero. The contact buffer 500 and the first buffering magnet 410 can cooperate to buffer the mounting plate 200 to enhance the buffering force. The repulsive force between the first buffering magnet 410 and the second buffering magnet 210 is sufficient, ensuring that the two never contact each other, which avoids strong collision between the first buffering magnet 410 and the second buffering magnet 210, emission of abnormal noise or damage.

Optionally, the limit plate 400 is located on the side of the dimming lens 100 close to the light source 700, and the contact buffer 500 is provided on the limit plate 400. Since the closer to the light source 700, the tighter the arrangement of the components and the more compact the structure, the thickness of the first buffering magnet 410 is limited, and the magnetism is also weaker. With combined buffering of contact buffer 500, the buffering force can be greatly increased.

In a preferred embodiment, a contact buffer 500 is further provided on the mounting plate 200 or the limit plate 400, and when the contact buffer 500 is in contact with the limit plate 400 or the mounting plate 200, the distance between the first buffering magnet 410 and the second buffering magnet 210 is less than 8 mm and greater than 3 mm. The contact buffer 500 and the first buffering magnet 410 can operate to buffer the mounting plate 200 to enhance the buffering force, and an elastic deformation space of 3 mm to 8 mm is reserved for the contact buffer 500, so that the contact buffer 500 can provide an effective buffering force, and the contact buffer 500 will not affect the movement of the dimming lens 100 during normal operation.

Optionally, the limit plate 400 is located on the side of the dimming lens 100 close to the light source 700, and the contact buffer 500 is provided on the limit plate 400. Further, the number of the contact buffers 500 can be two, which are located on the two sides of the first buffering magnet 410 respectively.

In a preferred embodiment, the contact buffer 500 is a soft rubber pad and is fixed to the mounting plate 200 or a fixing post 510 on the limit plate 400. On one hand, the fixing post 510 can increase the height of the soft rubber pad, and on the other hand, it facilitates the fixing of the soft rubber pad.

In other embodiments, the contact buffer 500 may also be a spring.

Optionally, the soft rubber pad has a cylindrical shape, and is sleeved upside down on the fixing post 510. The bottom of the cylindrical soft rubber pad is provided with a support column extending toward its opening. The outer diameter of the support column is less than the inner diameter of the cylindrical soft rubber pad. The gap between the support column and the inner wall of the cylindrical soft rubber pad provides a space for deformation of the support column, which avoids the abnormal noise caused by late deformation when it is subjected to a violent impact.

In a preferred embodiment, the dimming lens 100 is a magnifying lens or a focusing lens. The magnifying lens or the focusing lens is generally heavy and has a large moving distance. Therefore, large impact force will be caused when collision with other components, resulting in damage. Buffering is thus required to avoid such situation.

Figure 2:
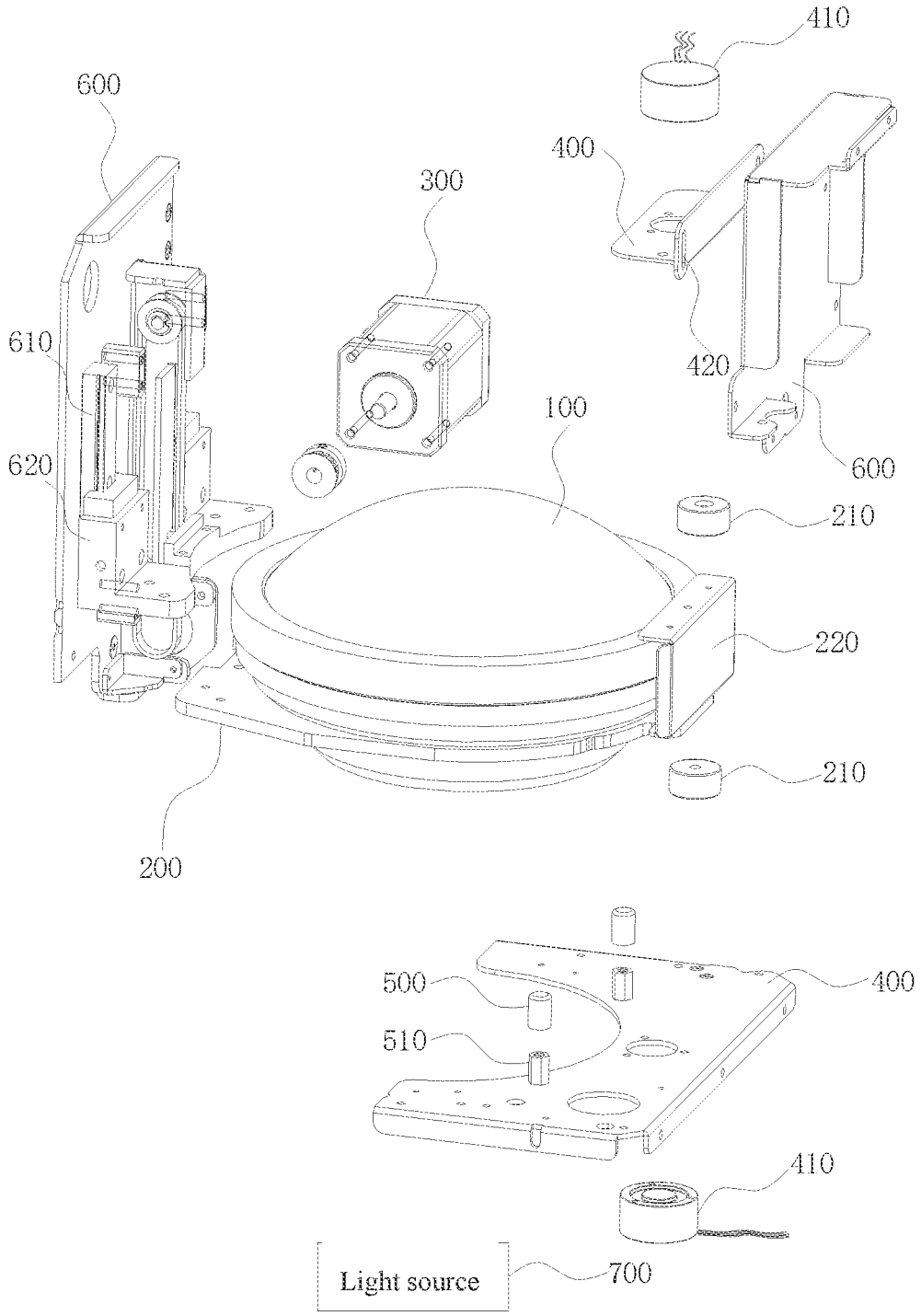
FIG. 2 is an explosion view of the stage light when the first buffering magnet of the present application is a power-off type electromagnet.

As shown in FIG. 2, in a preferred embodiment, the first buffering magnet 410 is a power-off type electromagnet that loses its magnetism when it is powered on and generates a magnetic force when it is powered off. Therefore, it can avoid to affect the driving of the dimming lens 100 by the drive mechanism 300, when the stage light is operating normally. The dimming lens 100 will be only buffered when the power is off.

The power-off type electromagnet relies on a built-in permanent magnet having a very strong attraction force to produce a strong attraction and holding force in the power-off state, and in the power-on state, since the magnetic force generated by the applied direct current is opposite to the inherent magnetic polarity of the built-in permanent magnet, the attraction forces cancel each other out so that the electromagnet does not generate an attraction force. The power-off type electromagnet is existing, which can be purchased directly from the market.

Optionally, during the normal operation of the stage light, when the second buffering magnet 210 is close to the power-off type electromagnet, the power-off type electromagnet is controlled to be powered on and demagnetized to avoid affecting the drive mechanism 300 driving the dimming lens 100. When the second buffering magnet 210 is far away from the power-off type electromagnet, the power-off type electromagnet is controlled to be powered off, thereby saving power. Meanwhile, although the power-off electromagnet is magnetic, it will not affect the movement of the dimming lens 100 as it is far away from the second buffering magnet 210.

It is apparent that the above-mentioned embodiments of the present application are merely examples for clearly illustrating the present application, and are not intended to limit the implementation methods of the present application. For those of ordinary skill in the art, other changes or modifications in different forms can be made on the basis of the above description. It is not necessary and impossible to list all the implementation methods here. Any modifications, equivalent replacements, improvements, etc. made within the spirit and principle of the present application shall be included in the protection scope of the claims of the present application.

The invention claimed is:

1. A stage light with a lens buffering feature, comprising a light source emitting light along an optical path; and a dimming lens provided on the optical path, the dimming lens being mounted on a mounting plate and configured to move freely along the optical path under driving of a drive mechanism, wherein a limit plate is provided on at least one side of the dimming lens along the direction of the optical path, the limit plate is provided with a first buffering magnet, the mounting plate is provided with a second buffering magnet corresponding to the first buffering magnet, and sides of the first buffering magnet and the second buffering magnet close to each other have same polarity.

2. The stage light with a lens buffering feature according to claim 1, wherein the first buffering magnet and/or the second buffering magnet are fixed by pasting, screws or a mounting box.

3. The stage light with a lens buffering feature according to claim 1, wherein the limit plate is located on one side of the dimming lens far away from the light source.

4. The stage light with a lens buffering feature according to claim 1, wherein a shelf extending along an emission direction of the optical path is fixed on the mounting plate, and the second buffering magnet is fixed to the shelf.

5. The stage light with a lens buffering feature according to claim 1, wherein the limit plate has a strip-shaped guide hole thereon extending along the direction of the optical path, and the limit plate is fixed by a screw passing through the strip-shaped guide hole.

6. The stage light with a lens buffering feature according to claim 1, wherein the limit plate is located on one side of the dimming lens close to the light source.

7. The stage light with a lens buffering feature according to claim 1, wherein the limit plate has an access hole thereon, and the first buffering magnet is located in the access hole.

8. The stage light with a lens buffering feature according to claim 1, wherein a contact buffer is further provided on the mounting plate or the limit plate, and when the mounting plate compresses the contact buffer to an extreme position, a distance between the first buffering magnet and the second buffering magnet is greater than zero.

9. The stage light with a lens buffering feature according to claim 8, wherein the contact buffer is a soft rubber pad and is fixed to the mounting plate or a fixing post on the limit plate.

10. The stage light with a lens buffering feature according to claim 1, wherein a contact buffer is further provided on the mounting plate or the limit plate, and when the contact buffer is in contact with the limit plate or the mounting plate, a distance between the first buffering magnet and the second buffering magnet is less than 8 mm and greater than 3 mm.

11. The stage light with a lens buffering feature according to claim 10, wherein the contact buffer is a soft rubber pad and is fixed to the mounting plate or a fixing post on the limit plate.

12. The stage light with a lens buffering feature according to claim 1, wherein the dimming lens is a magnifying lens or a focusing lens.

13. The stage light with a lens buffering feature according to claim 1, wherein the first buffering magnet is a power-off type electromagnet that loses magnetism when powered on and generates a magnetic force when powered off.

* * * * *